US009812780B2

(12) United States Patent
Gaddi et al.

(10) Patent No.: US 9,812,780 B2
(45) Date of Patent: Nov. 7, 2017

(54) TECHNIQUES OF TUNING AN ANTENNA BY WEAK COUPLING OF A VARIABLE IMPEDANCE COMPONENT

(71) Applicant: CAVENDISH KINETICS, INC., San Jose, CA (US)

(72) Inventors: Roberto Gaddi, 's-Hertogenbosch (NL); Paul Anthony Tornatta, Jr., Melbourne, FL (US); Ramadan A. Alhalabi, San Jose, CA (US)

(73) Assignee: CAVENDISH KINETICS, INC., San Jose, CA (US)

( * ) Notice: Subject to any disclaimer, the term of this patent is extended or adjusted under 35 U.S.C. 154(b) by 77 days.

(21) Appl. No.: 14/916,015

(22) PCT Filed: Sep. 17, 2014

(86) PCT No.: PCT/US2014/055987

§ 371 (c)(1),
(2) Date: Mar. 2, 2016

(87) PCT Pub. No.: WO2015/042092

PCT Pub. Date: Mar. 26, 2015

(65) Prior Publication Data

US 2016/0218431 A1 Jul. 28, 2016

Related U.S. Application Data

(60) Provisional application No. 61/881,292, filed on Sep. 23, 2013, provisional application No. 61/910,484, filed on Dec. 2, 2013.

(51) Int. Cl.

| | |
|---|---|
| ***H01Q 1/24*** | (2006.01) |
| ***H01Q 5/378*** | (2015.01) |
| ***H01Q 9/42*** | (2006.01) |
| ***H01Q 5/328*** | (2015.01) |

(52) U.S. Cl.
CPC ..... *H01Q 5/378* (2015.01); *H01Q 1/241* (2013.01); *H01Q 1/243* (2013.01); *H01Q 5/328* (2015.01); *H01Q 9/42* (2013.01)

(58) Field of Classification Search
CPC ..... H01Q 1/241; H01Q 1/243; H01Q 5/378; H01Q 5/328; H01Q 9/42
See application file for complete search history.

(56) References Cited

U.S. PATENT DOCUMENTS 7,911,402 B2 * 3/2011 Rowson ..... H01Q 1/243 343/700 MS
2009/0224991 A1 9/2009 Rowson et al.

FOREIGN PATENT DOCUMENTS

WO 02/078124 A1 10/2002
WO 2013033613 A2 3/2013

* cited by examiner

*Primary Examiner* — Hoang Nguyen
(74) *Attorney, Agent, or Firm* — Patterson & Sheridan, LLP

(57) ABSTRACT

The present invention generally relates to small antennas suitable for mobile devices operating in the high frequency and radio frequency bands in the range 100 MHz to 5 GHz. The antennas may be coupled to a DVC such as a MEMS DVC. The antenna may be coupled to a printed circuit board disposed inside of the mobile device, such as a mobile phone or smart phone.

30 Claims, 8 Drawing Sheets

TECHNIQUES OF TUNING AN ANTENNA BY WEAK COUPLING OF A VARIABLE IMPEDANCE COMPONENT

BACKGROUND OF THE INVENTION

Field of the Invention

Embodiments of the present invention generally relate to small antennas suitable for mobile devices operating in the high frequency and radio frequency bands in the range 100 MHz to 5 GHz.

Description of the Related Art

Reduced size portable devices that require radio communication in the 100 MHz-5 GHz spectrum are facing problems related to the design of appropriate antennas. There are fundamental and practical limitations when antennas operating in such spectrum need to fit a small physical volume. The result is insufficient level of radiated power and poor receiver sensitivity. Both these problems are related to the antenna radiation efficiency being too low.

State of the art antenna design techniques are able to mitigate such issues using specific broad band or multiple resonance antenna designs. These techniques are able to solve some of the specific design problems related to a particular device, but are still falling short of providing a generally adoptable antenna design technique that can meet radiation related specifications within the constraint of a small antenna volume.

Therefore, there is a need in the art for a technique to tune the antenna resonance frequency of a certain band of a multi-band antenna by means of an electromagnetically coupled parasitic element coupled to a variable impedance device without affecting other bands of the antenna.

SUMMARY OF THE INVENTION

The present invention generally relates to small antennas suitable for mobile devices operating in the high frequency and radio frequency bands in the range 100 MHz to 5 GHz. The antennas may be coupled to a digital variable capacitor (DVC) such as a micro electromechanical system (MEMS) DVC. The antennas may be coupled to a variable impedance device in general such as a switched inductor and/or capacitor bank. The antenna may be coupled to a printed circuit board disposed inside of the mobile device, such as a mobile phone or smart phone.

In one embodiment, an antenna structure comprises an antenna conductor coupled to a printed circuit board; and a coupling capacitor plate coupled to the printed circuit board. In another embodiment, a mobile device includes the antenna structure.

In another embodiment, an antenna structure comprises an antenna conductor coupled to a printed circuit board; and a parasitic element coupled to the printed circuit board. In another embodiment, a mobile device includes the antenna structure.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The present invention generally relates to small antennas suitable for mobile devices operating in the high frequency and radio frequency bands in the range 100 MHz to 5 GHz. The antennas may be coupled to a DVC such as a MEMS DVC. The antennas may be coupled to a variable impedance device in general such as a switched inductor and/or capacitor bank. The antenna may be coupled to a printed circuit board disposed inside of the mobile device, such as a mobile phone or smart phone.

Figure 1:
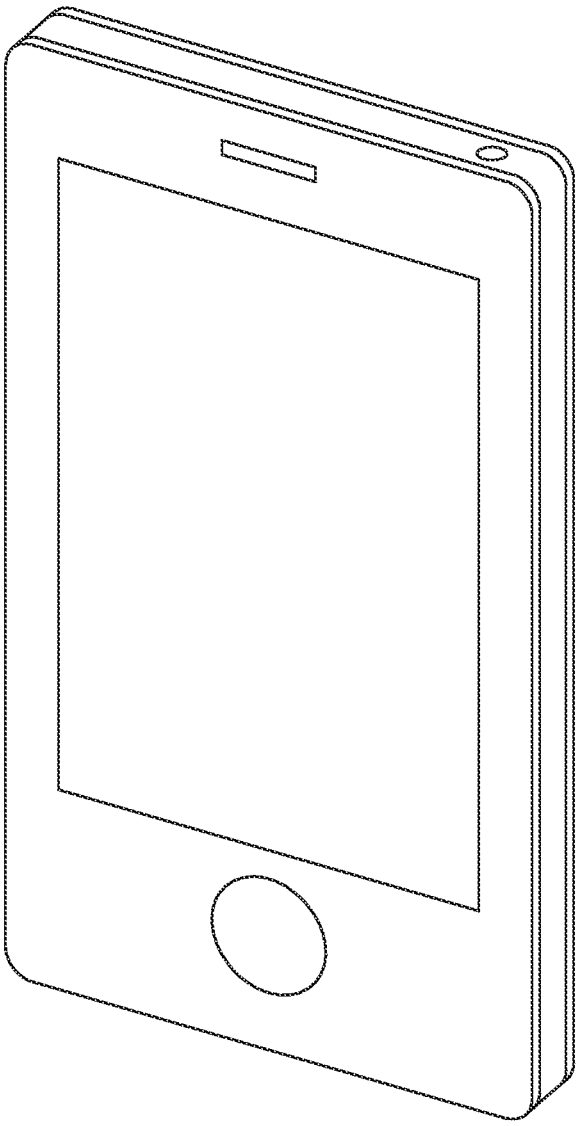
FIG. 1 is a schematic isometric illustration of a mobile phone that contains antennas according to one embodiment.
Figure 2:
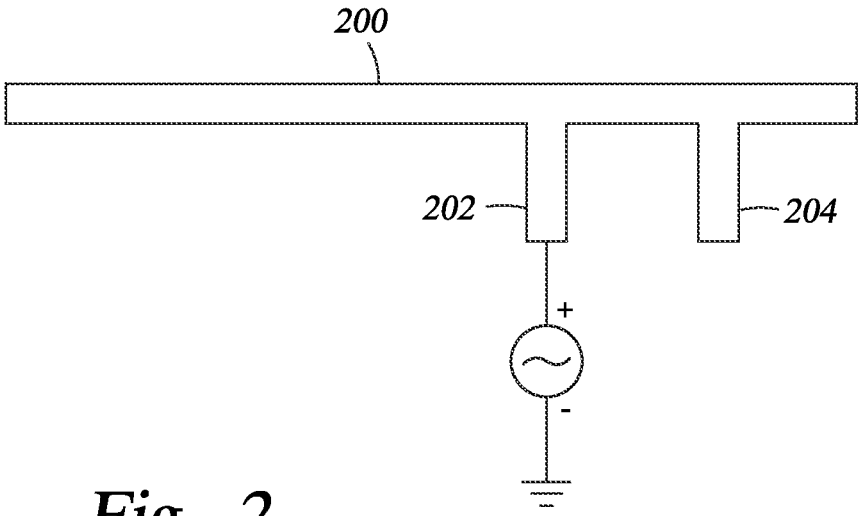
FIG. 2 is a schematic illustration of an antenna structure.

Small antennas which are suitable to be integrated in a portable radiofrequency device such as the mobile phone illustration in FIG. 1 are typically mounted on the top side or the back side of the mobile device, and the device acts as an active counter pole of the antenna. Such small antennas are typically designed as variations of simple monopole antenna, using forms such as (planar) inverted F antenna (P)IFA. The pattern of such antennas can be modified in order to adapt to the mechanical constraints of the device while maintaining its radiating characteristics. Nonetheless, the essence of the antenna design can be always described such as shown in FIG. 2.

In the following descriptions the term "ground" or "grounded connection" or "ground plane" will be adopted. In the case of battery operated devices such as mobile phones or smart phones or tablets, the definition of "ground" relates to the electric potential reference of the battery ("minus" pole) which is coupled to the main body (chassis) of the device.

The antenna conductor pattern 200 is responsible of generating unbalanced currents that will lead to radiated electromagnetic power. The power is fed into the antenna by means of a feed 202 which is typically in close proximity of a grounded connection 204 in the case of a PIFA implementation. Alternative antenna types such as inverted L (ILA) or monopole will not have a grounded connection but the general method here described is nonetheless applicable.

By appropriately shaping the conductor pattern 200, the desired frequency band can be covered by the antenna resonance and therefore electromagnetic power is radiated for those frequencies. This is unrelated to the specific impedance of the generator since at this stage the radiated efficiency of the antenna is of primary concern, defined as ratio of radiated power vs. power input into the antenna:

$$\eta_{rad} = \frac{P_{rad}}{P_{in}}$$

The total efficiency includes the return loss and can be related to the radiation efficiency $\eta_{rad}$ and the scattering parameter at the antenna feed $S_{11}$:

$$\eta_{tot}=(1-|\underline{S}_{11}|^2)\eta_{rad}$$

A matching network can generally be added at the feed in order to optimize total efficiency, without impacting the intrinsic radiation characteristics of the antenna. Since the embodiments discussed herein maximize the antenna radiation efficiency while tuning the resonance across a given bandwidth, it will be assumed the antenna impedance at resonance is close to the source impedance (typically 50 ohm) without loss of generality.

Figure 3:
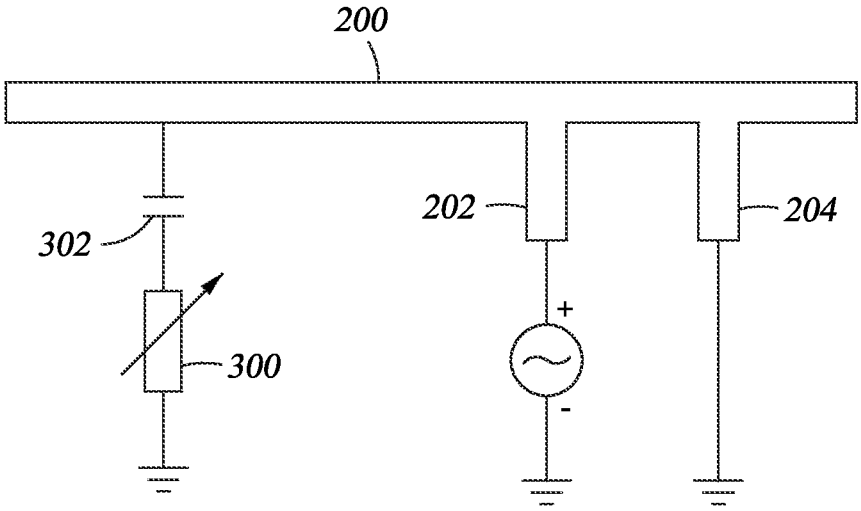
FIG. 3 is a schematic illustration of an antenna structure according to one embodiment.

FIG. 3 shows the method of tuning the resonance frequency of the antenna by coupling a variable impedance 300 to the antenna conductor pattern using a capacitor 302.

In one specific embodiment of the invention, the coupling capacitor 302 can be implemented by the same means used to implement the antenna conductor pattern 200. This can be done by adding a conductor plate 400 parallel to the antenna conductor pattern but spaced using a spacer material layer of thickness 402, as shown in FIG. 4.

In this particular implementation the antenna pattern is hanging off the edge of a ground plane 404, typically a printed circuit board (PCB), and a transmission line 406 is connecting the generator to the antenna feed 202. The variable impedance component 300 is mounted on the surface of the PCB and connected to the coupling capacitor plate 400 by the same means 408 as used to connect feed 202 and ground 204 to the antenna pattern.

Figure 4:
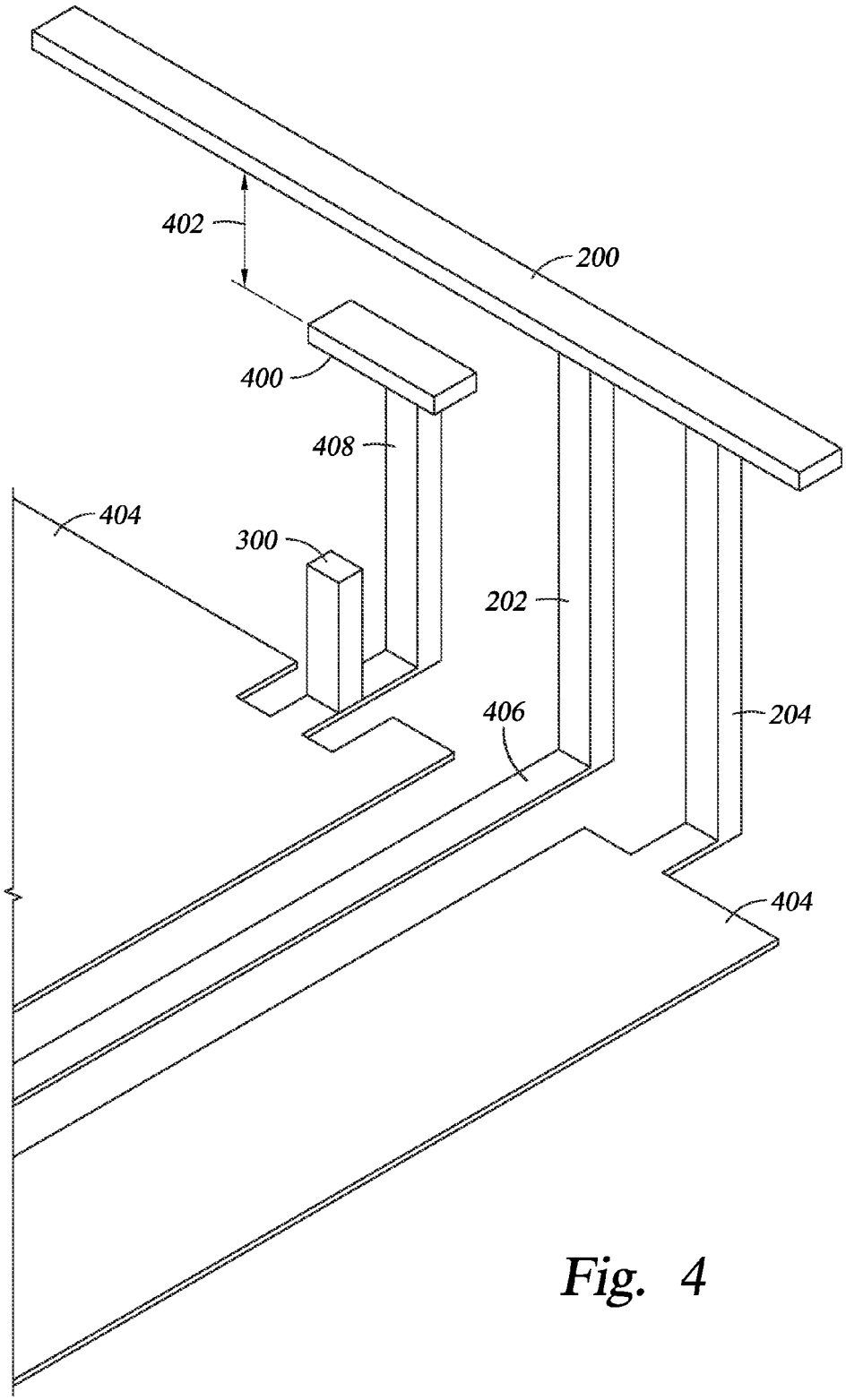
FIG. 4 is a schematic illustration of an antenna structure coupled to a printed circuit board according to one embodiment.

In a particular implementation, connecting bridges 202, 204 and 408 of FIG. 4 are C-clip (spring) or miniature pogo pins connectors, which are surface mounted on the PCB and generate an electrical contact to a specific area of the exposed conductor on the antenna body as the antenna+PCB system is mechanically assembled.

In a particular embodiment of this invention, the variable impedance component 300 consists of a digital variable capacitor. By varying the capacitor across its range of values $C_{MIN}$-$C_{MAX}$, the antenna resonance frequency is changing across the range $f_{MIN}$-$f_{MAX}$. Appropriate design of the antenna conductor pattern 200, of the location and size of the coupling capacitor plate 400 will allow covering the required telecommunication bands of interest within the $f_{MIN}$-$f_{MAX}$ total bandwidth.

Figure 5:
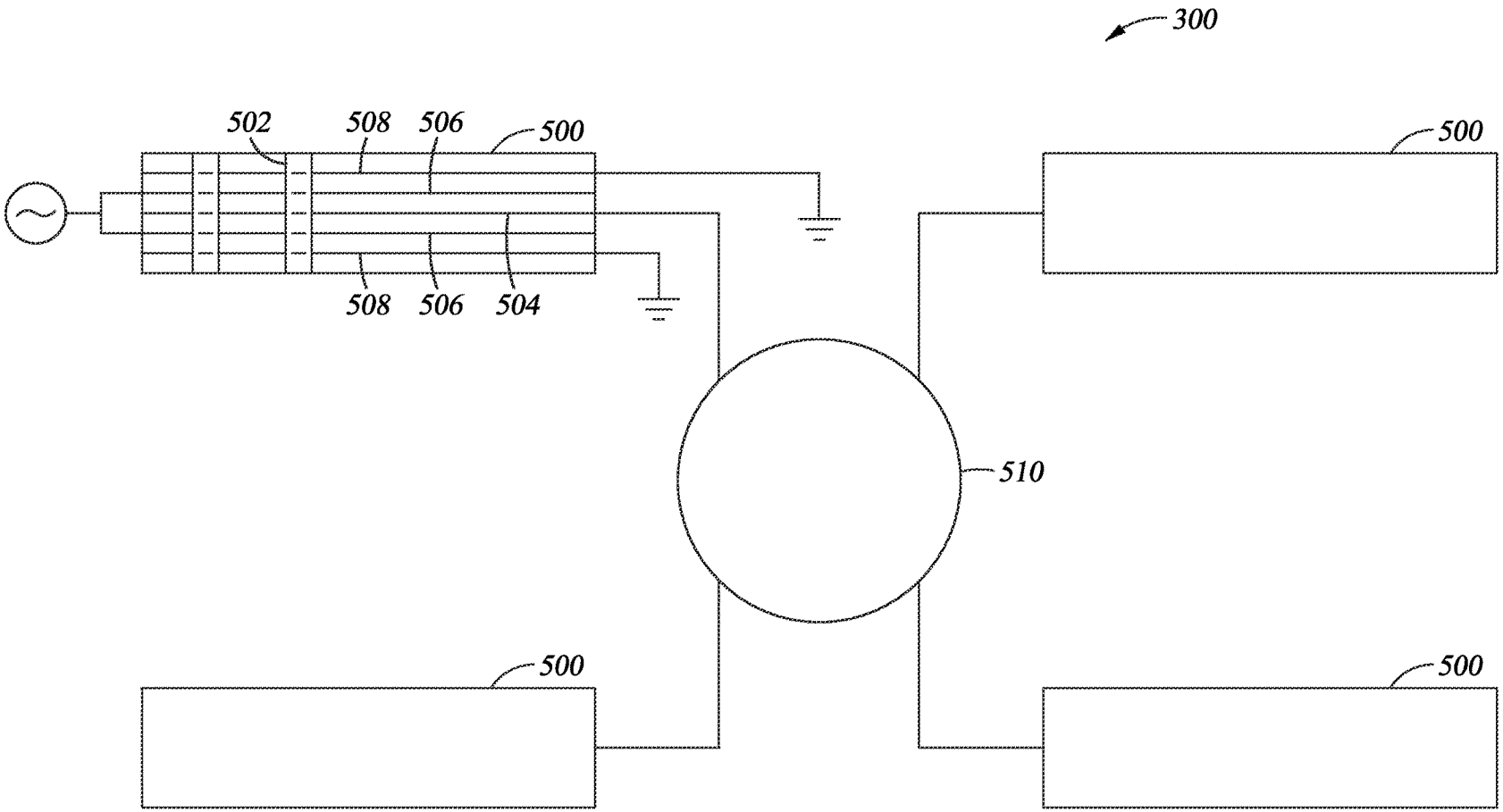
FIG. 5 is a schematic illustration of a DVC according to one embodiment.

FIG. 5 is a schematic illustration of a DVC 300 according to one embodiment. The DVC 300 includes a plurality of cavities 500. While only one cavity 500 is shown in detail, it is to be understood that each cavity 500 may have a similar configuration, although the capacitance for each cavity 500 may be different.

Each cavity has a RF electrode 504 which is coupled to an RF connector/solder bump 510. Additionally, each cavity has one or more pull-in electrodes 506 and one or more ground electrodes 508. The switching elements 502 (2 shown) are disposed over the electrodes 504, 506, 508. In fact, the switching elements 502 are electrically coupled to the ground electrodes 508. The switching elements 502 are movable to various spacing from the RF electrode 508 due to electrical current/potential applied to the pull-in electrodes 506.

Figure 6:
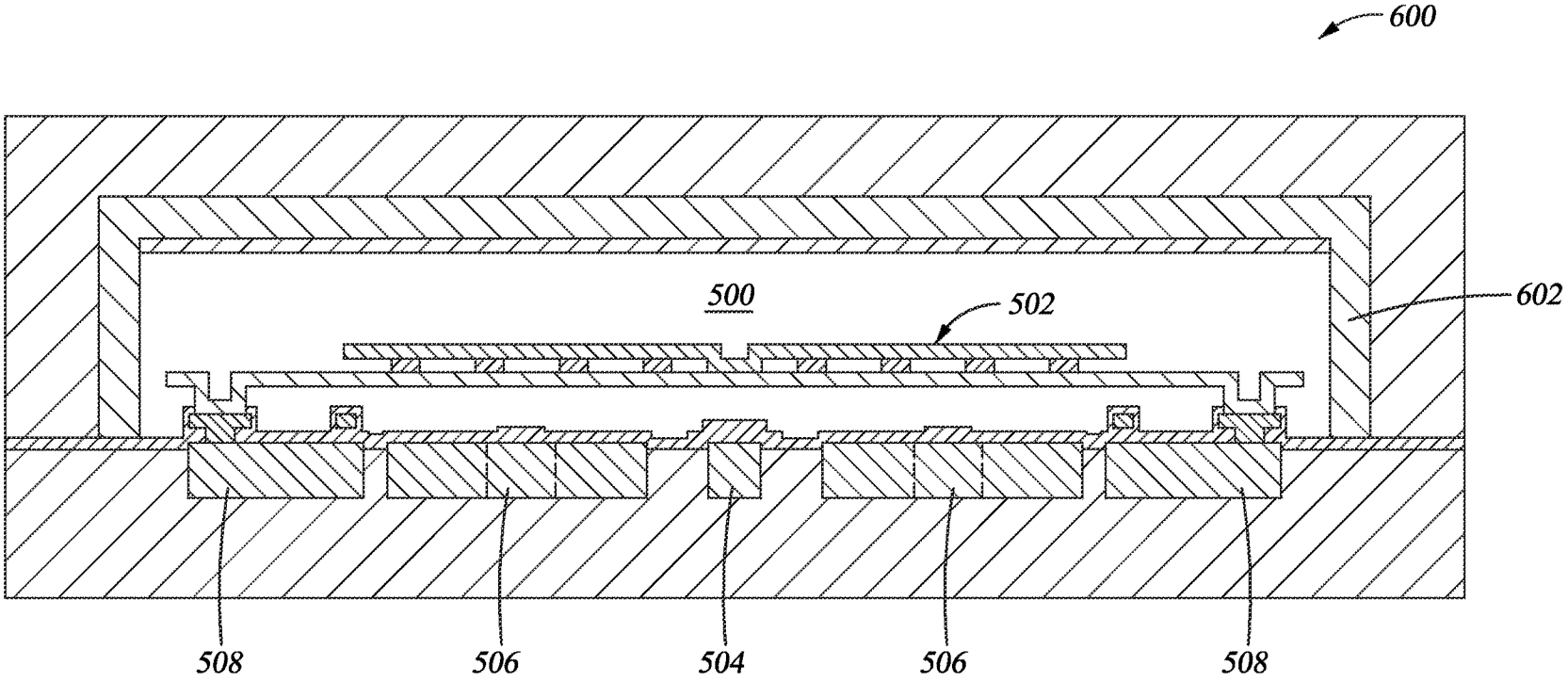
FIG. 6 is a schematic illustration of a MEMS device according to one embodiment.

FIG. 6 is a schematic illustration of a MEMS device 600 according to one embodiment. The MEMS device includes the electrodes 504, 506, 508 and the switching element 502 which is disposed in the cavity 500 and movable from a position close to the RF electrode 504 (referred to as the $C_{max}$ position) and a position spaced adjacent a pull-up electrode 602 (referred to as the $C_{min}$ position). The position of the switching elements 502 within the cavity 500 determines the capacitance for a particular cavity. By using the MEMS devices in a DVC, the antennas can be tuned as discussed herein.

Figure 7:
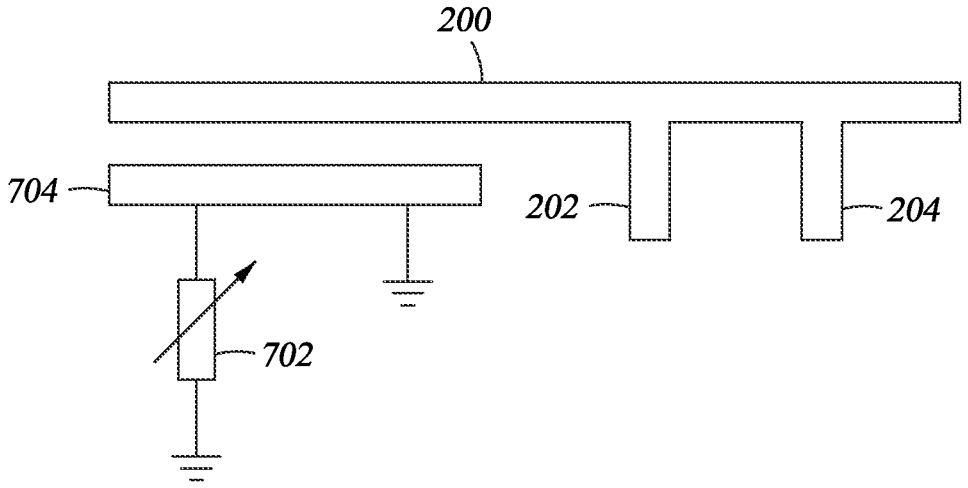
FIG. 7 is a schematic illustration of a dual band antenna according to one embodiment.

FIG. 7 is a schematic illustration of a dual band antenna according to one embodiment. The antenna has a low band section that is being fed directly from the RF source while the high band is being fed by electromagnetic coupling. The high band resonance frequency of the antenna can be tuned by connecting variable impedance 702 to the electromagnetically coupled parasitic element 704.

In one embodiment, the variable impedance component 702 comprises a DVC. By varying the capacitor across the range of values $C_{min}$-$C_{max}$, the antenna high band resonance frequency changes across the range $f_{min}$-$f_{max}$. Appropriate design of the antenna conductor pattern 200, of the electromagnetically coupled parasitic element 704 and the separation of the parasitic element 704 from the antenna pattern 200 will allow the high band to cover the required telecommunication bands of interest within the $f_{min}$-$f_{max}$ total bandwidth without impacting the low band.

Figure 8:
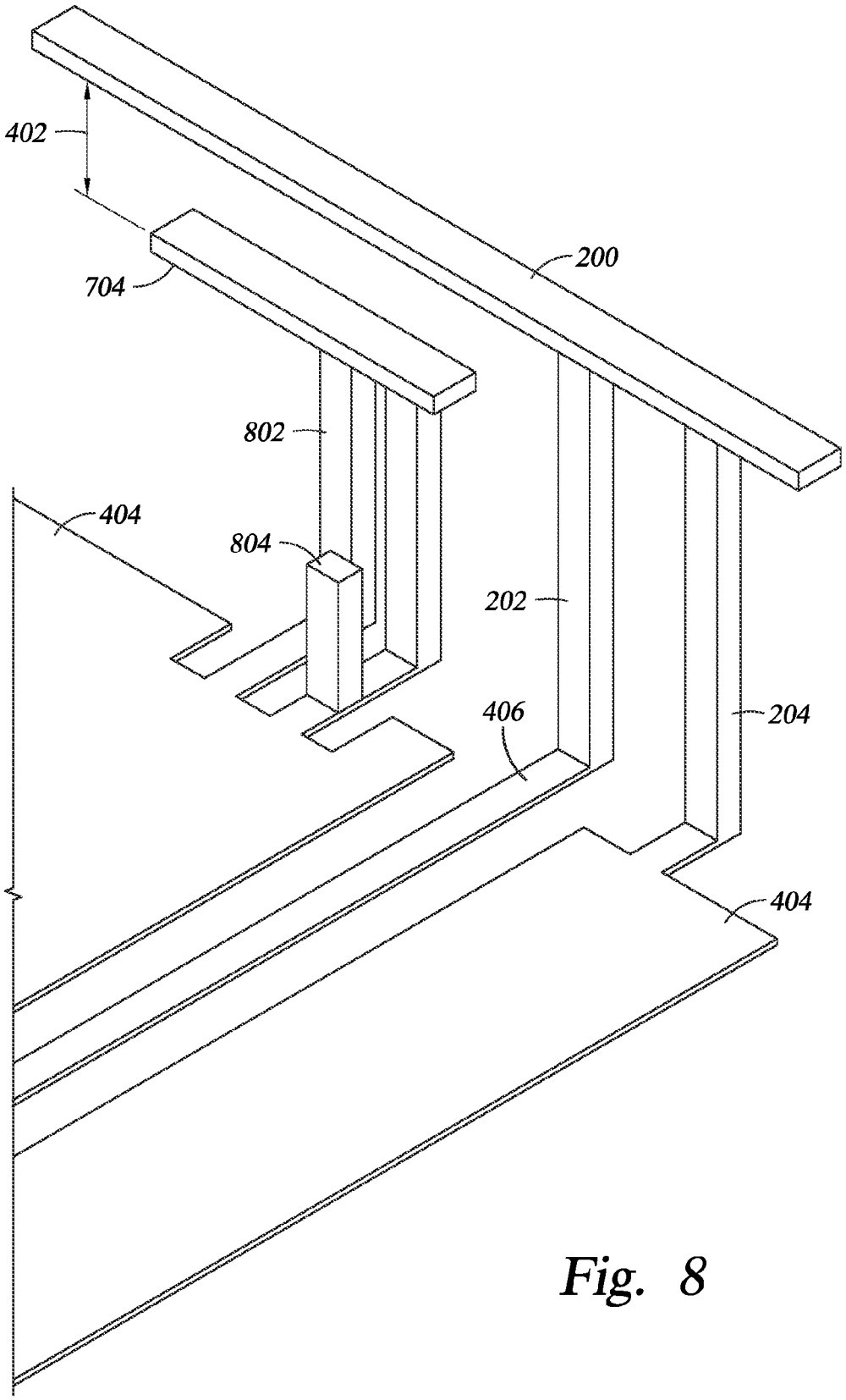
FIG. 8 is a schematic illustration of an antenna structure coupled to a printed circuit board according to another embodiment.

FIG. 8 is a schematic illustration of an antenna structure coupled to a printed circuit board according to another embodiment. As shown in FIG. 8, a grounded leg 802 of the parasitic resonator 704 (i.e., parasitic element) is coupled to the ground plane 404. The parasitic resonator 704 is also coupled through a DVC 804 to the ground plane 404.

The antenna conductor pattern 200 is designed to radiate in a specific band of interest and may have single or multiple resonances. The parasitic element 704 is designed to operate in another frequency band different from the frequency bands in which the antenna conductor pattern 200 operates. The parasitic element 704 is coupled to the antenna conductor pattern 200 over a small distance gap 402, and the parasitic element 704 produces a resonance that shows up at the feed point 202 of the antenna conductor pattern 200, effectively adding another resonance to the complete antenna structure. The parasitic element 704 is capacitively loaded with the DVC 804. The resonant frequency of the parasitic element 704 can be changed by changing the DVC loading. Increasing the capacitance lowers the resonant frequency. The entire system forms a multi-resonant structure with independent resonators. The parasitic element 704 connected to the DVC 804 is a frequency tunable device to provide a mean to vary the frequency of operation of a portion of the antenna resonance, without affecting the other resonant frequencies.

Figure 9:
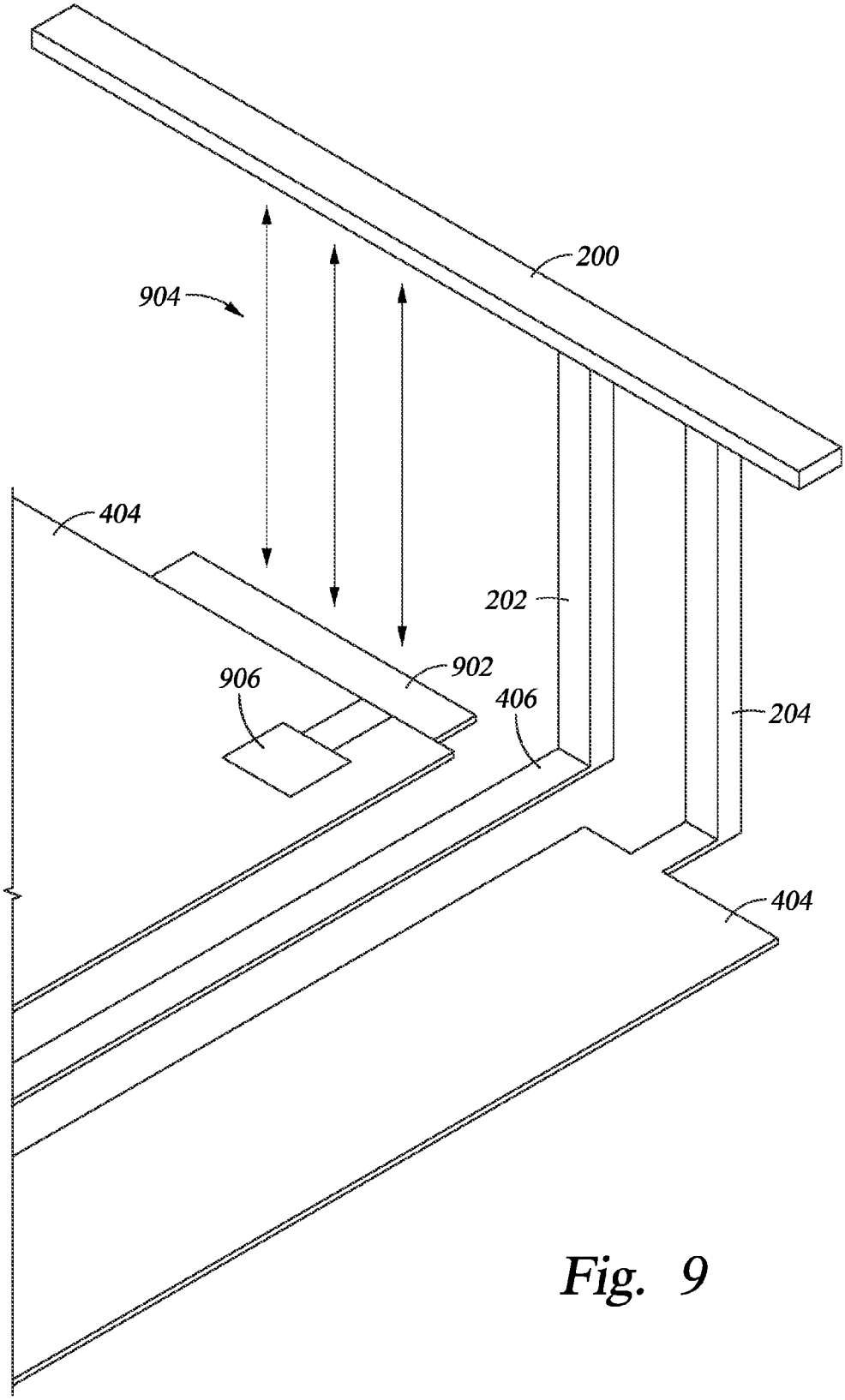
FIG. 9 is a schematic illustration of an antenna structure coupled to a printed circuit board according to another embodiment.

FIG. 9 is a schematic illustration of an antenna structure coupled to a printed circuit board according to another embodiment. As shown in FIG. 9, a capacitor plate 902 is printed on the printed circuit board 404 such that a parasitic resonator is present. A DVC connection point 906 is present between the capacitor plate 902 and the printed circuit board 404.

The antenna conducting pattern 200 is designed to radiate in a specific band of interest and have single or multiple resonances. The parasitic radiator, i.e., the capacitor plate 902, is designed to operate in another frequency band different from the antenna conducting pattern 200, i.e., main radiator, frequency bands. The parasitic radiator 902 is coupled to the main radiator 200 over a small distance gap 904 and produces its own resonance that shows up at the feed point of the main radiator 200, effectively adding another resonance to the complete antenna structure. The parasitic radiator 902 is capacitively loaded with the DVC 906. The resonant frequency of the parasitic resonator 902 can be changed by changing the DVC 906 loading. Increasing the capacitance lowers the resonant frequency. The entire system forms a multi-resonant structure with independent resonators. The resonator 902 connected to the DVC 906 is frequency tunable to provide means to vary the frequency of operation of a portion of the antenna resonance without effecting the other resonant frequencies.

Advantages of the embodiments herein are the ability to design narrow band antennas which can be tuned so that the overall frequency spectrum they can operate is as wide as required for modern portable radiofrequency devices. Another advantage is that the coupling technique which is described herein allows tuning the resonance frequency of the antenna by means of a simple variable impedance device such as a digital variable capacitor. Therefore, a single component is required to perform the tuning, which is very advantageous in applications where space constraints are of critical importance due to miniaturization. The embodiments herein also have the advantage of giving the ability to tune different bands of the antenna independent of each other which offers a great flexibility to the antenna designed to optimize the antenna performance over all desired frequency bands. As such, the designs shown and described herein create an independent, frequency tunable resonance in a multi-band antenna structure.

While the foregoing is directed to embodiments of the present invention, other and further embodiments of the invention may be devised without departing from the basic scope thereof, and the scope thereof is determined by the claims that follow.

The invention claimed is:

1. An antenna structure, comprising:

a linear antenna conductor coupled to a printed circuit board, wherein the antenna conductor hangs off the edge of the printed circuit board;

a parasitic element coupled to the printed circuit board through a grounded leg, wherein the parasitic element is spaced from and parallel to the antenna conductor; and a digital variable capacitor coupled between the parasitic element and the printed circuit board, wherein the digital variable capacitor is spaced from the grounded leg.

2. The antenna structure of claim 1, wherein the digital variable capacitor is a MEMS digital variable capacitor.

3. The antenna structure of claim 2, wherein the MEMS digital variable capacitor comprises a switching element movable between a first position and a second position.

4. The antenna structure of claim 3, wherein the antenna conductor and the parasitic element are coupled to a ground plane of the printed circuit board.

5. The antenna structure of claim 4, wherein the antenna conductor is coupled to a transmission line.

6. The antenna structure of claim 1, further comprising a MEMS digital variable capacitor coupled between the parasitic element and the printed circuit board.

7. The antenna structure of claim 1, wherein the antenna conductor and the parasitic element are coupled to a ground plane of the printed circuit board.

8. The antenna structure of claim 1, wherein the parasitic element is a capacitor plate.

9. A mobile device, comprising:

an antenna structure having:

a linear antenna conductor coupled to a printed circuit board, wherein the antenna conductor hands off the edge of the printed circuit board;

a parasitic element coupled to the printed circuit board through a grounded leg, wherein the parasitic element is spaced from and parallel to the antenna conductor; and a digital variable capacitor coupled between the parasitic element and the printed circuit board, wherein the digital variable capacitor is spaced from the grounded leg.

10. The mobile device of claim 9, wherein the digital variable capacitor is a MEMS digital variable capacitor.

11. The mobile device of claim 10, wherein the MEMS digital variable capacitor comprises a switching element movable between a first position and a second position.

12. The mobile device of claim 11, wherein the antenna conductor and the parasitic element are coupled to a ground plane of the printed circuit board.

13. The mobile device of claim 12, wherein the antenna conductor is coupled to a transmission line.

14. The mobile device of claim 9, further comprising a MEMS digital variable capacitor coupled between the parasitic element and the printed circuit board.

15. The mobile device of claim 9, wherein the mobile device is a mobile phone.

16. The mobile device of claim 9, wherein the parasitic element is a capacitor plate.

17. An antenna structure, comprising:

a linear antenna conductor coupled to a printed circuit board, wherein the antenna conductor hangs off the edge of the printed circuit board;

a coupling capacitor plate coupled to the printed circuit board through a grounded leg, wherein the coupling capacitor plate is spaced from and parallel to the antenna conductor; and a digital variable capacitor coupled between the coupling capacitor plate and the printed circuit board, wherein the digital variable capacitor is spaced from the grounded leg.

18. The antenna structure of claim 17, wherein the digital variable capacitor is a MEMS digital variable capacitor.

19. The antenna structure of claim 18, wherein the MEMS digital variable capacitor comprises a switching element movable between a first position and a second position.

20. The antenna structure of claim 19, wherein the antenna conductor is coupled to a ground plane of the printed circuit board.

21. The antenna structure of claim 20, wherein the antenna conductor is coupled to a transmission line.

22. The antenna structure of claim 17, further comprising a MEMS digital variable capacitor coupled between the coupling capacitor plate and the printed circuit board.

23. The antenna structure of claim 17, wherein the antenna conductor and the coupling capacitor plate are coupled to a ground plane of the printed circuit board.

24. A mobile device, comprising:

an antenna structure having:

a linear antenna conductor coupled to a printed circuit board, wherein the antenna conductor hangs off the edge of the printed circuit board;

a coupling capacitor plate coupled to the printed circuit board through a grounded leg, wherein the coupling capacitor plate is spaced from and parallel to the antenna conductor; and a digital variable capacitor coupled between the coupling capacitor plate and the printed circuit board, wherein the digital variable capacitor is spaced from the grounded leg.

25. The mobile device of claim 24, wherein the digital variable capacitor is a MEMS digital variable capacitor.

26. The mobile device of claim 25, wherein the MEMS digital variable capacitor comprises a switching element movable between a first position and a second position.

27. The mobile device of claim 26, wherein the antenna conductor is coupled to a ground plane of the printed circuit board.

28. The mobile device of claim 27, wherein the antenna conductor is coupled to a transmission line.

29. The mobile device of claim 24, further comprising a MEMS digital variable capacitor coupled between the coupling capacitor plate and the printed circuit board.

30. The mobile device of claim 24, wherein the mobile device is a mobile phone.

* * * * *